United States Patent [19]

Byers et al.

[11] Patent Number: 5,006,503

[45] Date of Patent: Apr. 9, 1991

[54] THERMALLY-TRANSFERABLE FLUORESCENT EUROPIUM COMPLEXES

[75] Inventors: Gary W. Byers; Derek D. Chapman, both of Rochester, N.Y.

[73] Assignee: Eastman Kodak Company, Rochester, N.Y.

[21] Appl. No.: 493,076

[22] Filed: Mar. 13, 1990

[51] Int. Cl.[5] ..... B41M 5/035; B41M 5/26

[52] U.S. Cl. ..... 503/227; 8/471; 428/195; 428/480; 428/690; 428/913; 428/914

[58] Field of Search ..... 8/471; 428/195, 480, 428/913, 914, 690; 503/227

[56] References Cited

U.S. PATENT DOCUMENTS

| | | | |
|---|---|---|---|
| 4,627,997 | 12/1986 | Ide | 428/216 |
| 4,860,027 | 8/1989 | Ozelis et al. | 346/1.1 |
| 4,866,025 | 9/1989 | Byers et al. | 503/227 |
| 4,871,714 | 10/1989 | Byers et al. | 503/227 |
| 4,876,234 | 10/1989 | Henzel | 503/227 |
| 4,876,237 | 10/1989 | Byers et al. | 503/227 |
| 4,891,351 | 1/1990 | Byers et al. | 503/227 |
| 4,891,352 | 1/1990 | Byers | 503/227 |

*Primary Examiner*—Bruce H. Hess

*Attorney, Agent, or Firm*—Harold E. Cole

[57] ABSTRACT

A donor element for thermal transfer comprising a support having on one side thereof a fluorescent europium complex dispersed in a polymeric binder. In a preferred embodiment, the complex has the formula:

wherein:

D is a substituted or unsubstituted, aromatic, 5- or 6-membered carbocyclic or heterocyclic moiety; and J is $—CF_3$, $—CH_3$, $—CH_2F$ or $—CHF_2$.

In another preferred embodiment, the europium atom may also have attached thereto at least one monodentate ligand with an electron-donating oxygen or nitrogen atom or at least one bidentate ligand with two electron-donating oxygen, nitrogen or sulfur atoms atoms capable of forming a 5- or 6-membered ring with the europium atom.

17 Claims, No Drawings

THERMALLY-TRANSFERABLE FLUORESCENT EUROPIUM COMPLEXES

This invention relates to fluorescent donor elements used in thermal transfer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

The system described above has been used to obtain visible dye images. However, for security purposes, to inhibit forgeries or duplication, or to encode confidential information, it would be advantageous to create non-visual ultraviolet absorbing images that fluoresce with visible emission when illuminated with ultraviolet light.

U.S. Pat. No. 4,627,997 discloses a fluorescent thermal transfer recording medium comprising a thermally-meltable, wax ink layer. In that system, the fluorescent material is transferred along with the wax material when it is melted. Wax transfer systems, however, are incapable of providing a continuous tone. Further, the fluorescent materials of that reference are incapable of diffusing by themselves in the absence of the wax matrix. It is an object of this invention to provide fluorescent materials useful in a continuous tone system which have sufficient vapor pressure to transfer or diffuse by themselves from a donor element to a dye-receiver.

U.S. Pat. Nos. 4,876,237, 4,871,714, 4,876,234, 4,866,025, 4,860,027, 4,891,351, and 4,891,352 all relate to thermally-transferable fluorescent materials used in a continuous tone system. However, none of those materials fluorescent a visible red color when illuminated with ultraviolet light.

In accordance with this invention, a donor element for thermal transfer is provided comprising a support having on one side thereof a fluorescent europium complex dispersed in a polymeric binder.

In a preferred embodiment of the invention, the europium complex has the formula:

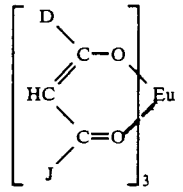

wherein: D is a substituted or unsubstituted, aromatic, 5- or 6-membered carbocyclic or heterocyclic moiety, e.g., phenyl, 2-thienyl, 2-furyl, 3-pyridyl, etc.; and J is $-CF_3$, $-CH_3$, $-CH_2F$ or $-CHF_2$.

In another preferred embodiment of the invention, the europium atom may also have one or more "auxiliary" monodentate or bidentate ligands attached thereto which substantially increases the fluorescence. Thus, these "higher" coordinate complexes have the following formula:

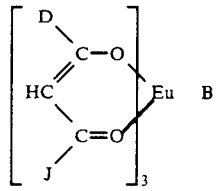

wherein: D and J are defined as above and B represents at least one monodentate ligand with an electron-donating oxygen or nitrogen atom, e.g., tri-n-octylphosphine oxide, pyridine-N-oxide or triphenylphosphine oxide; or at least one bidentate ligand with two electron-donating oxygen, nitrogen or sulfur atoms capable of forming a 5- or 6-membered ring with the europium atom, e.g., 2,2'-bipyridine, 1,10-phenanthroline, ethylene diamine or 1,2-diaminobutane.

The above fluorescent europium complexes are essentially non-visible, but emit with a unique red hue in the region of 610 to 625 nm when irradiated with 360 nm ultraviolet light. This red hue is highly desirable for security-badging applications.

Europium(III) is the only rare-earth known to be suitable for the practice of the invention. Rare earth metals, including europium, are described in the literature such as S, Nakamura and N. Suzuki, Polyhedron, 5, 1805 (1986); T. Taketatsu, Talanta, 29, 397 (1982); and H. Brittain, J. C. S. Dalton, 1187 (1979).

Compounds included within the scope of the invention include the following europium complexes derived from three beta-diketone ligands and optionally an auxiliary uncharged ligand(s):

| | A. Diketone Ligand | B. Auxiliary Ligand | Ratio Eu:A:B |
|---|---|---|---|
| (1) | 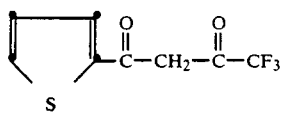 | None | 1:3:0 |

-continued
| | A. Diketone Ligand | B. Auxiliary Ligand | Ratio Eu:A:B |
|---|---|---|---|
| (2) | 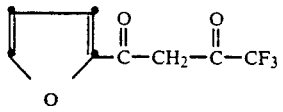 | None | 1:3:0 |
| (3) | 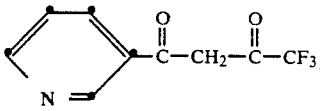 | None | 1:3:0 |
| (4) | 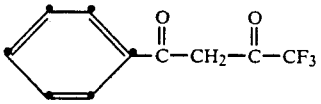 | None | 1:3:0 |
| (5) | 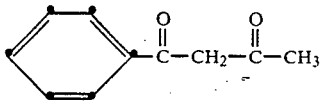 | None | 1:3:0 |
| (6) | 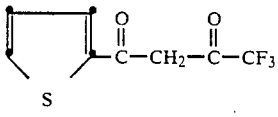 | 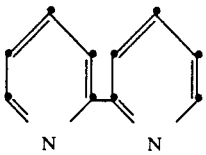 | 1:3:1 |
| (7) | 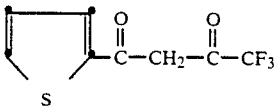 | 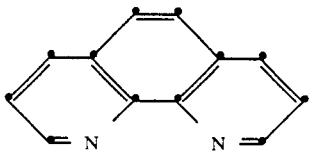 | 1:3:1 |
| (8) | 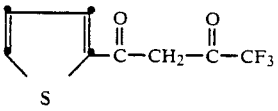 | $H_2NCH_2CH_2NH_2$ | 1:3:1 |
| (9) | 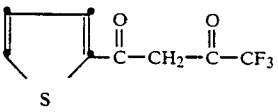 | $(C_6H_5)_3PO$ | 1:3:2 |
| (10) | 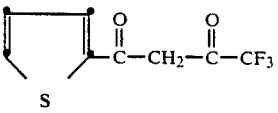 | 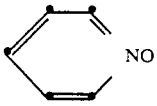 | 1:3:1 |
| (11) | 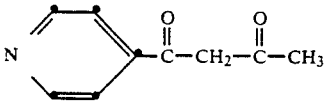 | 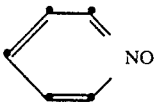 | 1:3:1 |
| (12) | 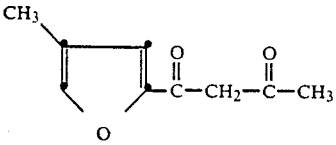 | 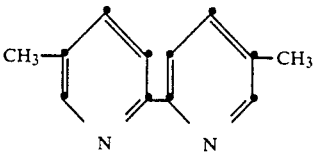 | 1:3:1 |

-continued

| | A. Diketone Ligand | B. Auxiliary Ligand | Ratio Eu:A:B |
|---|---|---|---|
| (13) | 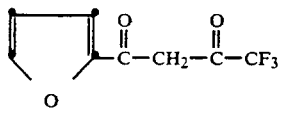 | 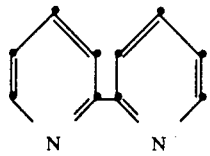 | 1:3:1 |
| (14) | 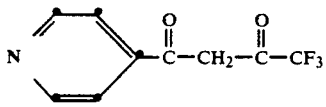 | 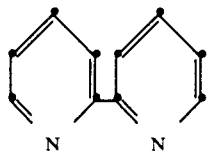 | 1:3:1 |
| (15) | 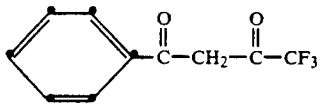 | $(n\text{-}C_8H_{17})_3PO$ | 1:3:2 |
| (16) | 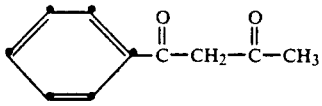 | 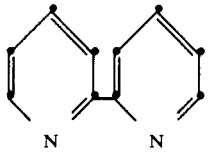 | 1:3:1 |
| (17) | 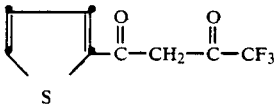 | 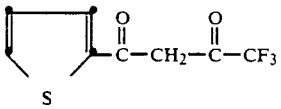 | 1:3:1* |

*This compound differs from the others in that it has four thenoyltrifluoroacetones coordinated with one europium, thus is octacoordinate and charged. To provide a neutral molecule, a salt is formed with tetramethylammonium as a counter-ion. It was found to have sufficient solubility to be coated and evaluated.

A visible dye can also be used in a separate or the same area of the donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

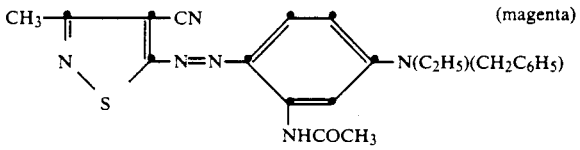
(magenta)

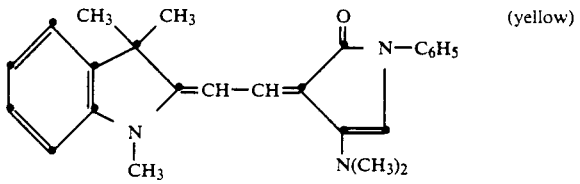
(yellow)

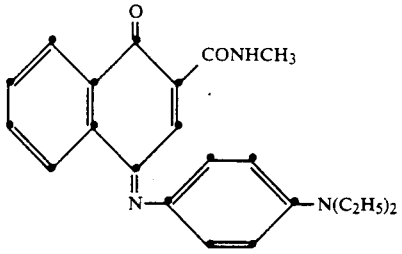
(cyan)

or any of the dyes disclosed in U.S. Pat. No. 4,541,830, the disclosure of which is hereby incorporated by reference. The above dyes may be employed singly or in combination to obtain a monochrome. The above image dyes and fluorescent dye may be used at a coverage of from about 0.01 to about 1 g/m$^2$, preferably 0.1 to about 0.5 g/m$^2$.

The fluorescent material in the donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The fluorescent material layer of the donor element may be coated on the support or printed thereon by a printing technique such as a gravure process.

Any material can be used as the support for the donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

When using the donor element of the invention with a resistive head, the reverse side of the donor element is coated with a slipping layer to prevent the printing head from sticking to the donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711, 4,737,485, 4,738,950, 4,824,050 or 4,717,712. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The receiving element that is used with the donor element of the invention usually comprises a support having thereon an image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the receiving element may also be reflective such as baryta-coated paper, polyethylene-coated paper, white polyester (polyester with white pigment incorporated therein), an ivory paper, a condenser paper or a synthetic paper such as duPont Tyvek ®.

The image-receiving layer may comprise, for example, a polycarbonate, a polyurethane, a polyester, polyvinyl chloride, poly(styrene-co-acrylonitrile), poly(caprolactone) or mixtures thereof. The image-receiving layer may be present in any amount which is effective for the intended purpose. In general, good results have been obtained at a concentration of from about 1 to about 5 g/m$^2$.

As noted above, the donor elements of the invention are used to form a transfer image. Such a process comprises imagewise-heating a donor element as described above and transferring a fluorescent material image to a receiving element to form the transfer image.

The donor element of the invention may be used in sheet form or in a continuous roll or ribbon. If a continuous roll or ribbon is employed, it may have only the fluorescent europium complex thereon as described above, with or without an image dye, or may have alternating areas of different dyes, such as sublimable magenta and/or yellow and/or cyan and/or black or other dyes. Such dyes are disclosed in U.S. Pat. Nos. 4,541,830, 4,698,651, 4,695,287, 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the donor element comprises a poly(ethylene terephthalate) support coated with sequential repeating areas of magenta, yellow, and cyan dye and the fluorescent material as described above, and the above process steps are sequentially performed for each color to obtain a three-color dye transfer image containing a fluorescent image.

Thermal printing heads which can be used to transfer fluorescent material and dye from the donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

If a laser is used to transfer dye from the dye-donor to the receiver, then an absorptive material is used in the dye-donor. Any material that absorbs the laser energy may be used such as carbon black or non-volatile infrared-absorbing dyes or pigments which are well known to those skilled in the art. Cyanine infrared absorbing dyes may also be employed with infrared diode lasers as described in DeBoer application Ser. No. 221,163 filed July 19, 1988, the disclosure of which is hereby incorporated by references.

Several different kinds of lasers could conceivably be used to effect the thermal transfer of dye from a donor sheet to the dye-receiving element, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Lasers which can be used to transfer dye from the dye-donor element to the dye image-receiving element are available commercially. There can be employed, for example, Laser Model SDL-2420-H2 ® from Spectrodiode Labs, or Laser Model SLD 304 V/W ® from Sony Corp.

A thermal transfer assemblage of the invention comprises (a) a donor element as described above, and (b) a receiving element as described above, the receiving element being in a superposed relationship with the donor element so that the fluorescent material layer of the donor element is in contact with the image-receiving layer of the receiving element.

The following examples are provided to illustrate the invention.

PREPARATION 1

Hexacoordinate complexes are obtained by solution reaction of three moles of a diketone ligand and one mole of a soluble europium salt under mildly alkaline conditions.

Compound 1 is available commercially from Kodak Laboratory and Research Products. Compound 4 was prepared in the following manner (other 6-coordinate complexes may be prepared in a similar manner):

Compound 4

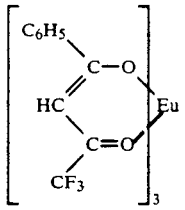

Europium nitrate (450 mg, 1.0 mmole) and benzoyl trifluoroacetone (650 mg, 3.0 mmole) were dissolved in ethanol (15 ml) and stirred with warming. The solution was adjusted to approximately pH 8.5 with tetramethylammonium hydroxide (25% in methanol) and allowed to stir for 15 min. After this time, the product was aided in precipitating by the addition of water (50 ml), filtered, and dried.

PREPARATION 2

Octacoordinate complexes involving a bidentate auxiliary ligand are obtained by reaction of one mole of a hexacoordinate complex with one mole of the desired neutral ligand.

Compound 6 was prepared in the following manner (other 8-coordinate complexes may be prepared in a similar manner).

Compound 6

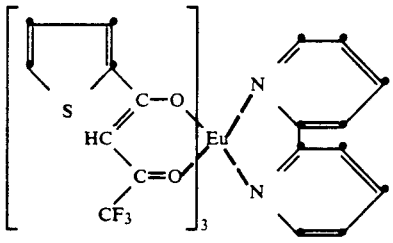

Europium(III) thenoyltrifluoroacetonate trihydrate (Compound 1) (860 mg, 1.0 mmoles) was dissolved in ethanol (10. ml). 2,2'-Bipyridine (160 mg, 1.0 mmole) dissolved in ethanol (10. ml) was added with stirring. After 15 min, 20 ml of water was added and the resulting precipitate was filtered and dried.

PREPARATION 3

Octacoordinate complexes involving a monodentate auxiliary ligand are obtained by reaction of one mole of a hexacoordinate complex with two moles of the desired neutral ligand.

Compound 9 was prepared in the following manner (other 8-coordinate complexes may be prepared in a similar manner):

Compound 9

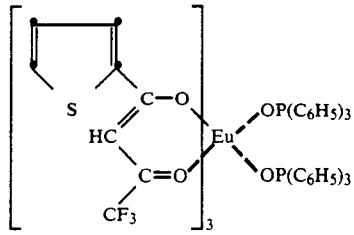

Europium(III) thenoyltrifluoroacetonate trihydrate (Compound 1) (870 mg, 1.0 mmole) and triphenylphosphine oxide (556 mg, 2.0 mmole) were dissolved in ethanol (8. ml) with stirring. After 10 minutes, the resulting precipitate was filtered and dried.

PREPARATION 4

Octacoordinate complexes involving only diketone ligands are obtained by reaction of one mole of a soluble europium salt with four moles of a diketone ligand.

Compound 17 was prepared as follows.

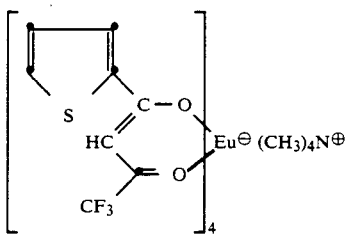

Europium nitrate (450 mg, 1.0 mmole), thenoyltrifluoroacetone (889 mg, 4.0 mmole), and tetramethyl ammonium hydroxide (1.46 g, 25% in methanol, 4.0 mmole) were dissolved in ethanol (20. ml) and heated to boiling. After slowly cooling to room temperature, water (20. ml) was added. The resulting precipitate was filtered and dried.

EXAMPLE 1

This example shows the fluorescence obtained by thermally transferring 6-coordinate europium complexes from a donor to a receiver.

A donor element was prepared by coating the following layers in the order recited on a 6 μm poly(ethylene terephthalate) support:

(1) a subbing layer of duPont Tyzor TBT ® titanium tetra-n-butoxide (0.12 g/m$^2$) from 1-butanol; and (2) a layer containing the europium fluorescent complex of the diketone ligand as identified above (0.38 g/m$^2$) or control material identified below (0.16 g/m$^2$) in a cellulose acetate butyrate (17% acetyl and 28% butyryl) binder (0.43 g/m$^2$ except control at 0.32 g/m$^2$) coated from a cyclopentanone, toluene and methanol solvent mixture.

On the back side of the element was coated:

(1) a subbing layer of duPont Tyzor TBT ® titanium tetra-n-butoxide (0.12 g/m$^2$) from 1-butanol; and (2) a slipping layer of Emralon 329 ® polytetrafluoroethylene dry film lubricant (Acheson Colloids) (0.54 g/m$^2$) and S-Nauba 5021 ® Carnauba Wax (Shamrock Technology) (0.003 g/m$^2$) and coated from a n-propyl acetate, toluene, 2-propanol and 1-butanol solvent mixture.

CONTROL MATERIALS

The following materials are available commercially from Kodak Laboratory Products and Chemicals Division:

Control 1:

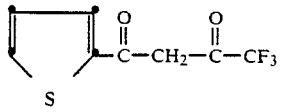

4,4,4-trifluoro-1-(2-thienyl)-1,3-butanedione

Control 2:

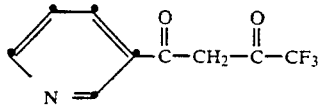

4,4,4-trifluoro-1-(3-pyridyl)-1,3-butanedione

Control 3:

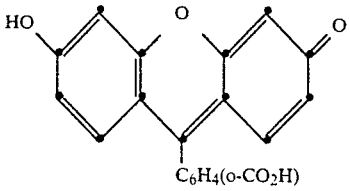

Fluorescein

Control 4:

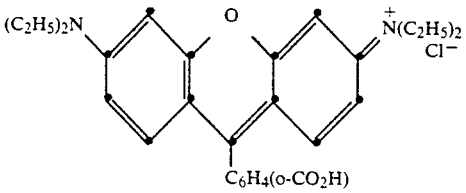

Rhodamine B

Control 5:

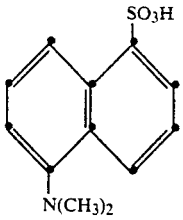

DANS Acid

A receiving element was prepared by coating a solution of Makrolon 5700 ® (Bayer A.G. Corporation) a bisphenol-A polycarbonate resin (2.9 g/m$^2$) and FC-431 ® surfactant (3M Corporation) (0.16 g/m$^2$) in a methylene chloride and trichloroethylene solvent mixture on a transparent 175 μm polyethylene terephthalate support subbed with a layer of poly(acrylonitrile-co-vinylidene chloride-co-acrylic acid) (14:79:7 wt ratio) (0.05 g/m$^2$).

The fluorescent material layer side of the donor element strip approximately 9 cm×12 cm in area was placed in contact with the image-receiving layer of the receiver element of the same area. The assemblage was fastened in the jaws of a stepper motor driven pulling device. The assemblage was laid on top of a 14 mm diameter rubber roller and a TDK Thermal Head L-133 (No. 6-2R16-1) and was pressed with a spring at a force of 3.6 kg against the donor element side of the assemblage pushing it against the rubber roller.

The imaging electronics were activated causing the pulling device to draw the assemblage between the printing head and roller at 3.1 mm/sec. Coincidentally, the resistive elements in the thermal print head were pulsed at a per pixel pulse width of 8 msec to generate a maximum density image. The voltage supplied to the print head was approximately 25 v representing approximately 1.6 watts/dot (13 mjoules/dot).

The receiving element was separated from the donor element and the relative emission was evaluated with a spectrofluorimeter using a fixed intensity 360 nm excitation beam and measuring the relative area under the emission spectrum from 375 to 700 nm. The following results were obtained (all transferred europium complexes emitted between 610 and 625 nm):

TABLE 1

| Compound | Relative Emission* | Visual Color |
|---|---|---|
| None | <1 | Not visible |
| Comparison* | 100 | Blue |
| Compound 1 | 5 | Moderate red |
| Compound 2 | 5 | Moderate red |
| Compound 3 | 1 | Faint red |
| Compound 4 | 3 | Moderate red |
| Compound 5 | 1 | Faint red |
| Control 1 | <1 | Not visible |
| Control 2 | <1 | Not visible |
| Control 3 | <1 | Not visible |
| Control 4 | <1 | Not visible |
| Control 5 | <1 | Not visible |

*Compared to the following compound, normalized to 100 (emission between 400–500 nm).

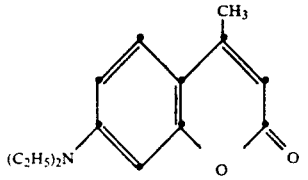

This compound is the subject of U.S. Pat. No. 4,876,237.

The above results show that the compounds of the invention have a unique red fluorescence and more intense transferred images than the control compounds of the prior art.

EXAMPLE 2

This example is similar to Example 1 but shows the enhanced fluorescence obtained with 8-coordinate europium complexes as compared to the corresponding 6-coordinate complex.

Donor elements were prepared as described in Example 1, using the fluorescent europium complex of the diketone and auxiliary ligand identified above.

Receiving elements were prepared as in Example 1.

The evaluation of fluorescence was done as described in Example 1. The following results were obtained:

TABLE 2

| Compound | Relative Emission* | Visual Color |
|---|---|---|
| None | <1 | Not visible |
| Compound 1 | 5 | Moderate red |
| Compound 6 | 27 | Intense red |
| Compound 7 | 32 | Intense red |
| Compound 9 | 54 | Intense red |
| Compound 10 | 20 | Red |
| Compound 17 | 32 | Intense red |

*Compared to the same compound as in Example 1.

The above results again show that the compounds of the invention have a unique red fluorescence and more intense transferred images than the control compounds of the prior art.

The invention has been described in detail with particular reference to preferred embodiments thereof, but it will be understood that variations and modifications can be effected within the spirit and scope of the invention.

What is claimed is:

1. A donor element for thermal transfer comprising a support having on one side thereof a fluorescent europium complex dispersed in a polymeric binder, said complex having the formula:

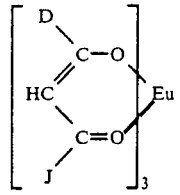

wherein:

D is a substituted or unsubstituted, aromatic, 5- or 6-membered carbocyclic or heterocyclic moiety; and J is $—CF_3$, $—CH_3$, $—CH_2F$ or $—CHF_2$.

2. The element of claim 1 wherein D represents phenyl, 2-thienyl, 2-furyl or 3-pyridyl.

3. The element of claim 1 wherein said complex has the formula:

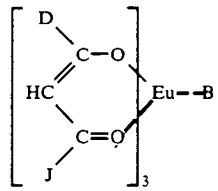

wherein:

D is a substituted or unsubstituted, aromatic, 5- or 6-membered carbocyclic or heterocyclic moiety;

J is $—CF_3$, $—CH_3$, $—CH_2F$ or $—CHF_2$; and

B represents at least one monodentate ligand with an electron-donating oxygen or nitrogen atom or at least one bidentate ligand with two electron-donating oxygen, nitrogen or sulfur atoms capable of forming a 5- or 6-membered ring with the europium atom.

4. The element of claim 3 wherein B represents tri-n-octylphosphine oxide, pyridine-N-oxide or triphenylphosphine oxide.

5. The element of claim 3 wherein B represents 2,2'-bipyridine, 1,10-phenanthroline, ethylene diamine or 1,2-diaminobutane.

6. The element of claim 3 wherein D represents phenyl, 2-thienyl, 2-furyl or 3-pyridyl.

7. The element of claim 1 wherein said donor element comprises sequential repeating areas of magenta, yellow and cyan dye, and said fluorescent complex.

8. In a process of forming a transfer image comprising imagewise-heating a donor element comprising a support having on one side thereof a layer comprising a material dispersed in a polymeric binder, and transferring an image to a receiving element to form said transfer image, the improvement wherein said material is a fluorescent europium complex, said complex having the formula:

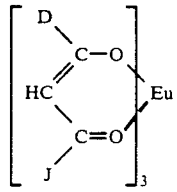

wherein:

D is a substituted or unsubstituted, aromatic, 5- or 6-membered carbocyclic or heterocyclic moiety; and J is $-CF_3$, $-CH_3$, $-CH_2F$ or $-CHF_2$.

9. The process of claim 8 wherein said complex has the formula:

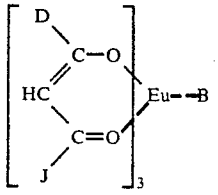

wherein:

D is a substituted or unsubstituted, aromatic, 5- or 6-membered carbocyclic or heterocyclic moiety;

J is $-CF_3$, $-CH_3$, $-CH_2F$ or $-CHF_2$; and

B represents at least one monodentate ligand with an electron-donating oxygen or nitrogen atom or at least one bidentate ligand with two electron-donating oxygen, nitrogen or sulfur atoms capable of forming a 5- or 6-membered ring with the europium atom.

10. The process of claim 8 wherein said support is poly(ethylene terephthalate) which is coated with sequential repeating areas of magenta, yellow and cyan dye, and said fluorescent complex, and said process steps are sequentially performed for each color to obtain a visible three-color dye transfer image and a fluorescent image.

11. In a thermal transfer assemblage comprising:

(a) a donor element comprising a support having on one side thereof a layer comprising a material dispersed in a polymeric binder, and (b) a receiving element comprising a support having thereon an image-receiving layer, said receiving element being in a superposed relationship with said donor element so that said material layer is in contact with said image-receiving layer, the improvement wherein said material is a fluorescent europium complex, said complex having the formula:

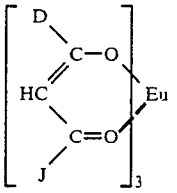

wherein:

D is a substituted or unsubstituted, aromatic, 5- or 6-membered carbocyclic or heterocyclic moiety; and J is $-CF_3$, $-CH_3$, $-CH_2F$ or $-CHF_2$.

12. The assemblage of claim 11 wherein D represents phenyl, 2-thienyl, 2-furyl or 3-pyridyl.

13. The assemblage of claim 11 wherein said complex has the formula:

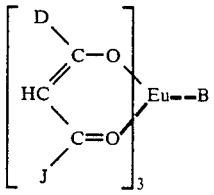

wherein:

D is a substituted or unsubstituted, aromatic, 5- or 6-membered carbocyclic or heterocyclic moiety;

J is $-CF_3$, $-CH_3$, $-CH_2F$ or $-CHF_2$; and

B represents at least one monodentate ligand with an electron-donating oxygen or nitrogen atom or at least one bidentate ligand with two electron-donating oxygen, nitrogen or sulfur atoms capable of forming a 5- or 6-membered ring with the europium atom.

14. The assemblage of claim 13 wherein B represents tri-n-octylphosphine oxide, pyridine-N-oxide or triphenylphosphine oxide.

15. The assemblage of claim 13 wherein B represents 2,2'-bipyridine, 1,10-phenanthroline, ethylene diamine or 1,2-diaminobutane.

16. The assemblage of claim 13 wherein D represents phenyl, 2-thienyl, 2-furyl or 3-pyridyl.

17. The assemblage of claim 11 wherein said support of said donor element is poly(ethylene terephthalate) which is coated with sequential repeating areas of magenta, yellow and cyan dye, and said fluorescent complex.

* * * * *